US009222264B1

(12) United States Patent
Reid

(10) Patent No.: US 9,222,264 B1
(45) Date of Patent: Dec. 29, 2015

(54) RETRACTABLE AWNING

(71) Applicant: Luke S. Reid, Drumheller (CA)

(72) Inventor: Luke S. Reid, Drumheller (CA)

( * ) Notice: Subject to any disclaimer, the term of this patent is extended or adjusted under 35 U.S.C. 154(b) by 0 days.

(21) Appl. No.: 14/505,135

(22) Filed: Oct. 2, 2014

Related U.S. Application Data

(60) Provisional application No. 61/885,729, filed on Oct. 2, 2013.

(51) Int. Cl.

| | |
|---|---|
| ***E04F 10/08*** | (2006.01) |
| ***E04F 10/10*** | (2006.01) |
| ***E04F 10/06*** | (2006.01) |
| ***E06B 9/38*** | (2006.01) |
| ***E05F 15/10*** | (2006.01) |
| ***E05F 15/20*** | (2006.01) |

(52) U.S. Cl.
CPC ..... *E04F 10/10* (2013.01); *E04F 10/0603* (2013.01); *E05F 15/10* (2013.01); *E05F 15/2076* (2013.01); *E06B 9/38* (2013.01)

(58) Field of Classification Search
CPC ..... E04F 10/18; E04F 10/10; E05F 15/10; E05F 15/2076; E06B 9/38
USPC ..... 160/61, 62
See application file for complete search history.

(56) References Cited

U.S. PATENT DOCUMENTS

| | | | | |
|---|---|---|---|---|
| 992,447 | A | 5/1911 | Pearson | |
| 2,239,242 | A * | 4/1941 | Miller | E04F 10/10 160/149 |
| 2,244,012 | A * | 6/1941 | Johnson | E04F 10/10 160/165 |
| 2,252,677 | A * | 8/1941 | Otto | E04F 10/10 160/61 |
| 2,708,775 | A | 5/1955 | Maas | |
| 2,952,049 | A | 9/1960 | Vetere | |
| 2,967,567 | A * | 1/1961 | Heckerman | E04F 10/10 160/172 R |
| 5,307,856 | A | 5/1994 | Murray | |
| 5,433,259 | A | 7/1995 | Faludy | |
| 6,006,809 | A | 12/1999 | Williams et al. | |
| 8,281,841 | B2 | 10/2012 | Landry | |
| 8,347,935 | B2 | 1/2013 | Svirsky et al. | |
| 8,356,652 | B2 | 1/2013 | Westgarth | |

* cited by examiner

*Primary Examiner* — Blair M Johnson
(74) *Attorney, Agent, or Firm* — Robert C. Montgomery; Montgomery Patent & Design, LLC

(57) ABSTRACT

A retractable awning has a frame structure with a plurality of louvers traversing a frame opening. Each louver is pivotally attached to enable rotation. The system is provided with electric motors and mechanical actuators to raise and lower the frame as well as rotate the louvers. Additionally, the angle of the entire awning and length of deployment is selectable. The awning can also be secured by closing the louvers and locking the frame to the building, thus forming a protective cover for the respective door or window against severe storms, looting, theft, or the like.

20 Claims, 7 Drawing Sheets

RETRACTABLE AWNING

RELATED APPLICATIONS

The present invention is a continuation-in-part of, was first described in, and claims the benefit of U.S. Provisional Application No. 61/885,729, filed Oct. 2, 2013, the entire disclosures of which are incorporated herein by reference.

FIELD OF THE INVENTION

The present invention relates to an awning system that extends, retracts, and pivots to provide optimal shade.

BACKGROUND OF THE INVENTION

Awnings are often used on homes and businesses to provide protection against direct sun glare as well as provide an aesthetic decorative element. However, such awnings are typically of a fixed nature, and often greatly restrict outside vision access at all times whether it is sunny or not. Also, such awnings form a sail, and can be destroyed in high winds often causing damage to the structure upon which they are mounted as well. As such, it is often necessary to remove such awnings before such storms arrive. Should the arriving storm be of hurricane strength, many home and business owners protect the windows with the installation of plywood. This obviously takes a great deal of time, and can be difficult to do when the storm is fast approaching. Accordingly, there exists a need for a means by which the functionality and usefulness of an awning can be maintained, and yet modified to address the problems as described above. The development of the present invention fulfills this need.

SUMMARY OF THE INVENTION

The inventor has seen a need for such a device to provide multiple retractable means for manipulating an awning of a structure.

In order to accomplish this need, it is an object of the present invention to provide such a retractable awning, including a housing assembly adapted to be mounted to a structure above an opening thereof, a first post assembly attached to and extending down from a first side of the housing assembly, a second post assembly attached to and extending down from a second side of the housing assembly, and a louvered panel assembly attached to and supported by the first and second post assemblies. In at least one (1) embodiment, a pair of locking mechanisms are attached to respective bottoms of the first and second post assemblies to secure the device to a ground.

It is a further object of the present invention to provide where the louvered panel assembly, first post assembly, and second post assembly are synchronously and selectively tilted between an upper position and a lower position relative to the housing assembly via a tilting adjustment means.

It is a further object of the present invention to provide where the louvered panel assembly, first post assembly, and second post assembly are synchronously and selectively raised or lowered relative to the housing assembly by a vertical adjustment means.

It is a further object of the present invention to provide where the louvered panel assembly is selectively opened or closed relative to the first and second post assemblies by an opening adjustment means.

It is yet another object of the present invention to provide where a control panel is located within the housing and in electrical communication between a controller and said tilting adjustment means, said vertical adjustment means, and said opening adjustment means. The control panel independently operates the tilting adjustment means, vertical adjustment means, and opening adjustment means. In at least one (1) embodiment, the controller is a wall-mounted switch. In at least another embodiment, the controller is a hand-held remote control.

It is still yet another object of the present invention, the first and second post assemblies each further comprise a plurality of telescoping post elements. In this embodiment, the louvered panel assembly comprises a plurality of louver panels each attached to and spanning a distance between individual post elements of the first and said second post assemblies.

It is still yet another object of the present invention to provide, for each of the first and second post assemblies, a plurality of spring pins, each affixing adjacent post elements to each other; a release pulley housed within the housing, a release cable attached between the release pulley and attached to each of the plurality of spring pins, and a release motor in electrical communication with the control panel and operably motioning the release pulley.

It is still yet another object of the present invention to provide such a tilting adjustment means for each post assembly to include a lift pulley extending outwardly from a respective housing side, a lift cable routed around the lift pulley and affixed to a lower end of the respective post assembly, a lift motor in electrical communication with the control panel and operably motioning the lift pulley. In this manner, the control panel synchronously activates the lift motors to operate the lift pulleys to gather the lift cables to selectively tilt the first post assembly, the second post assembly, and the louvered panel assembly to a desired position.

It is still yet another object of the present invention to provide such a vertical adjustment means for each post assembly to include a collapsing pulley housed within the housing, a collapsing cable routed around the collapsing pulley and affixed to a lower end of the respective post assembly, a collapsing motor in electrical communication with the control panel and operably motioning the collapsing pulley. In this manner, the control panel synchronously activates the collapsing motors to operate the collapsing pulleys to gather the collapsing cables in order to selectively raise or lower the first post assembly, the second post assembly, and the louvered panel assembly to a desired position.

It is a further object of the present invention to provide such an opening adjustment means for the louvered panel assembly to include a pair of rotating pulleys housed within the housing, a pair of rotating cables each routed around a respective rotating pulley and affixed to opposing sides of each louver panel, a pair of rotating motors in electrical communication with the control panel and operably motioning each rotating pulley. In this manner, the control panel synchronously activates each rotating motor to operate each rotating pulley to gather each rotating cable to selectively open or close each louvered panel to a desired position between zero and approximately ninety degrees.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
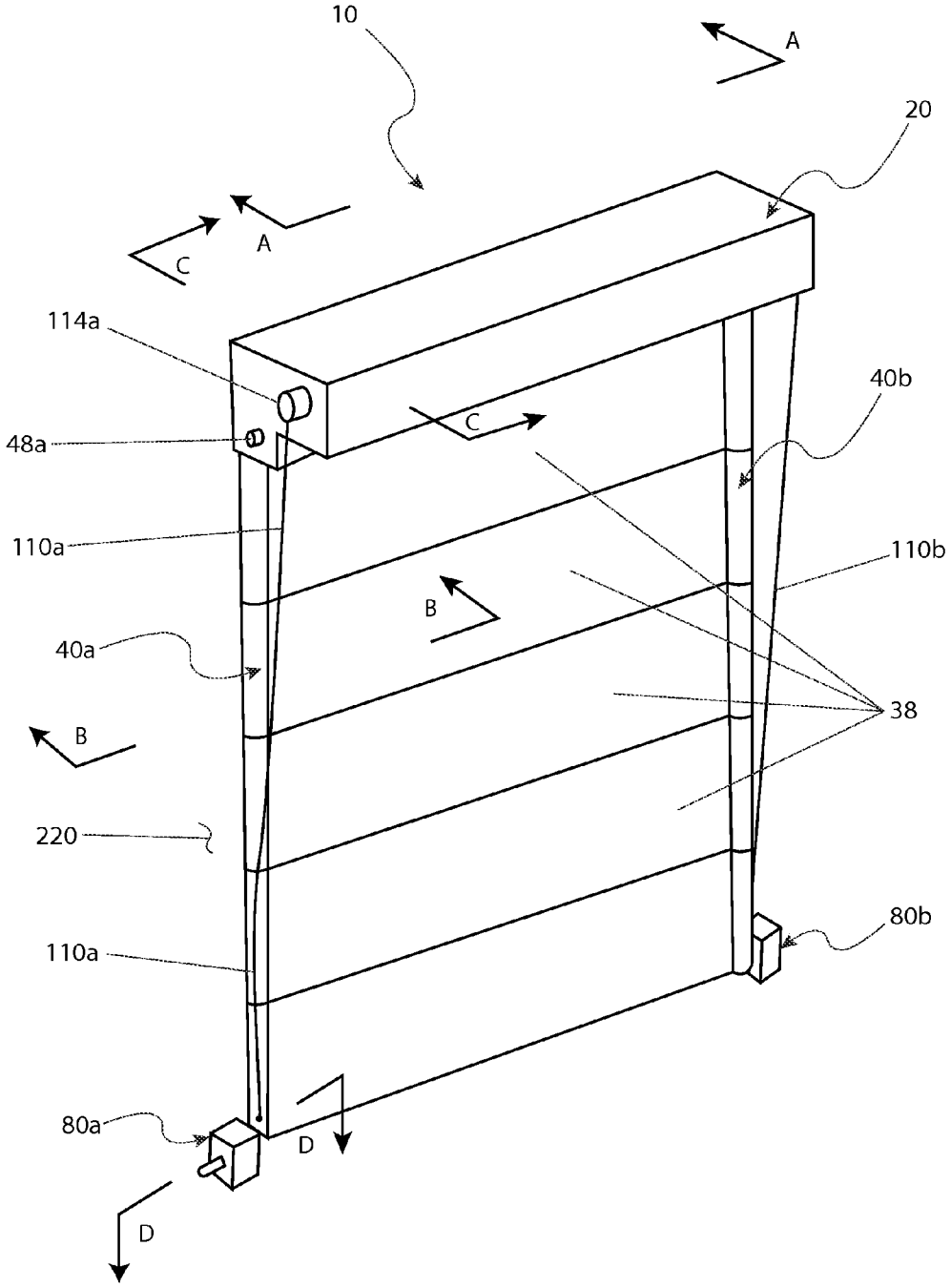
FIG. 1 is a front perspective view of a retractable awning system 10 depicting a closed and secured state, according to a preferred embodiment of the present invention.

10 retractable awning system
20 system housing assembly
21 front housing panel
22 rear housing panel
24 bottom housing panel
26*a* first housing side panel
26*b* second housing side panel
26*c* third housing side panel
28 top housing panel
30 fastener aperture
32 fastener
34 housing slot
38 louvered panel assembly
40*a* first support post assembly
40*b* second support post assembly
42*a* first post section
42*b* second post section
42*c* third post section
42*d* fourth post section
42*e* fifth post section
44*a* first lip feature
44*b* second lip feature
46 post slot
48*a* first axle bracket
48*b* second axle bracket
49 lock aperture
50 eyelet
80*a* first lock assembly
80*b* second lock assembly
82 anchor bracket
84 locking pin
86 locking pin aperture
88 padlock aperture
90 padlock
100 spring pin assembly
102 spring pin
104 pin eyelet
106 spring
110*a* first louvered panel assembly lift cable
110*b* second louvered panel assembly lift cable
112*a* first lift motor
112*b* second lift motor
114*a* first lift pulley
114*b* second lift pulley
120*a* first spring pin release cable
120*b* second spring pin release cable
122*a* first release motor
122*b* second release motor
124*a* first release pulley
124*b* second release pulley
130*a* first post collapsing cable
130*b* second post collapsing cable
132*a* first collapsing motor
132*b* second collapsing motor
134*a* first collapsing pulley
134*b* second collapsing pulley
140*a* first louver rotate cable
140*b* second louver rotate cable
142*a* first rotate motor
142*b* second rotate motor
144*a* first rotate pulley
144*b* second rotate pulley
150 remote controller
152 remote controller housing
154*a* first remote controller switch
154*b* second remote controller switch
154*c* third remote controller switch
156 signal
160 control module
161 receiver
162 antenna
163 wiring
164 power source wiring
165 grommet
170 switch panel assembly
172 switch panel housing
174*a* first switch panel switch
174*b* second switch panel switch
174*c* third switch panel switch
200*a* first louver
200*b* second louver
200*c* third louver
200*d* fourth louver
200*e* fifth louver
202 louver pulley
204 louver pulley shaft
206 pulley cable fastener
210 window/door opening
220 structure
230 sill/ground surface

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a retractable awning system (herein described as the "system") 10, which provides a means to extend, retract, and pivot a retractable louvered panel assembly 38 to selectively provide shade or light through a window/door opening 210 as desired.

Figure 2:
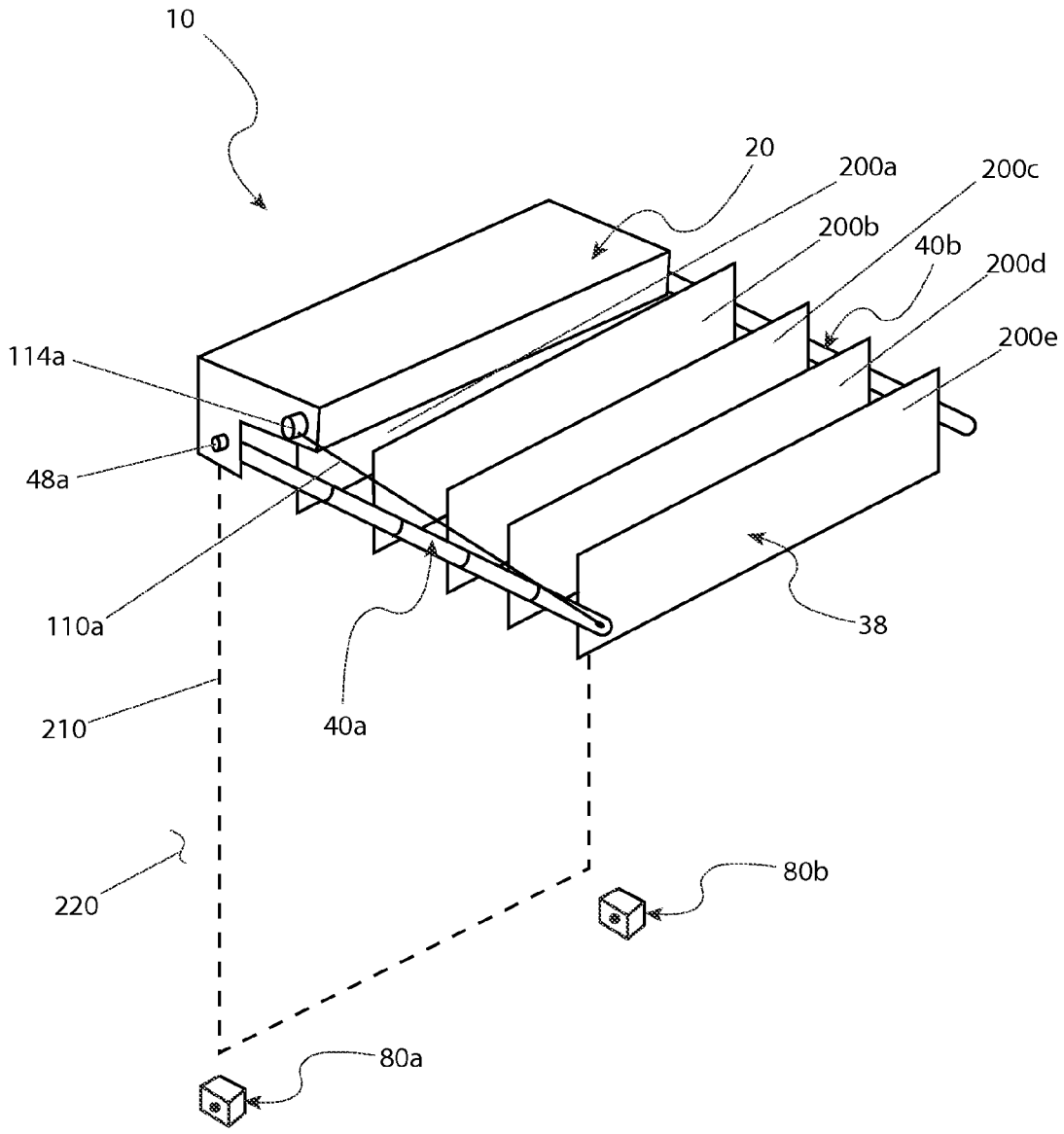
FIG. 2 is a is a front perspective view of the retractable awning system 10 depicting a horizontally deployed and tilted state, according to a preferred embodiment of the present invention.

Referring now to FIGS. 1 and 2, environmental views of the system 10, in accordance with the preferred embodiment of the present invention, are disclosed. The system 10 is envisioned to be installed upon an exterior portion of a commercial or residential structure 220, covering a window or door opening 210, and providing control of exterior light entering the structure 220. The system 10 provides a louvered panel assembly 38 being supported by a housing assembly 20 mounted to the structure 220. The housing assembly 20 extends across a top portion of the system 10, and a framework extends downwardly along opposing side portions including a first support post assembly 40*a* and a second support post assembly 40*b*, being arranged in a parallel manner to each other. The housing assembly 20 provides a generally "L"-shaped enclosure made up of a rear housing panel 22, a bottom housing panel 24, a first housing side panel 26*a*, a second housing side panel 26*b*, a third housing side panel 26*c*, and a top housing panel 28. The third housing side panel 26*c* forms a second bottom of the housing assembly 20, defining an overhang.

The housing assembly 20 provides enclosure of equipment including a control module 160 and a plurality of motors 122*a*, 122*b*, 132*a*, 132*b*, 142*a*, 142*b* which provide a means to tilt the louvered panel assembly 38 between vertical and horizontal orientations, and to extend and collapse telescoping portions of each support post assembly 40*a*, 40*b* including a first post section 42*a*, a second post section 42*b*, a third post section 42*c*, a fourth post section 42*d*, and a fifth post section 42*e*. The tubular sections 42*a*, 42*b*, 42*c*, 42*d*, 42*e* are in mechanical communication with cable take-up pulleys 114*a*, 114*b*, 124*a*, 124*b*, 134*a*, 134*b*, 144*a*, 144*b* also housed within the housing assembly 20 and corresponding cables 110*a*, 110*b*, 120*a*, 120*b*, 130*a*, 130*b*, 140*a*, 140*b* being motioned by the motors 122*a*, 122*b*, 132*a*, 132*b*, 142*a*, 142*b* (see FIGS. 3, 4, and 5).

The support post assemblies 40*a*, 40*b* protrude downwardly through housing slot portions 34 being formed or machined in the bottom housing panel portion 24 of the housing assembly 20, and are rotatingly attached to the bottom housing panel 24 via respective first axle bracket 48*a* and second axle bracket 48*b* portions. The post sections 42*a*, 42*b*, 42*c*, 42*d*, 42*e* are interlocked with each other when fully extended to form a fixed-length assembly (see FIG. 4). The louvered panel assembly 38 may be configured into a compact form by collapsing the support post assemblies 40*a*, 40*b* over each other when a maximum amount of light is desired (see FIG. 3).

An embodiment of the louvered panel assembly 38 is shown here having five (5) overlapping and individually tilting louver portions including a first louver 200*a*, a second louver 200*b*, a third louver 200*c*, a fourth louver 200*d*, and a fifth louver 200*e*; however, it is understood that an actual number and width dimension of the louvers 200*a*, 200*b*, 200*c*, 200*d*, 200*e* would be based upon a height and width of the window/door opening 210 being covered by the system 10. As seen in FIG. 2, the cables 110*a*, 110*b*, 120*a*, 120*b*, 130*a*, 130*b*, 140*a*, 140*b* provide a means to tilt the entire louvered panel assembly 38 up away from the structure 220, as well as also tilt the louvers 200*a*, 200*b*, 200*c*, 200*d*, 200*e* with respect to the louvered panel assembly 38, thereby producing a variety of lighting and shading effects.

A pair of lock assemblies 80*a*, 80*b* located at each bottom corner of the system 10 secures the device 10 to the structure 220 as well as provides protection during inclement weather conditions. The lock assemblies 80*a*, 80*b* serve to anchor opposing bottom end portions of the support post assemblies 40*a*, 40*b* to a subjacent sill/ground surface 230, being optionally locked in position using respective padlocks 90 (see FIG. 6).

Figure 3:
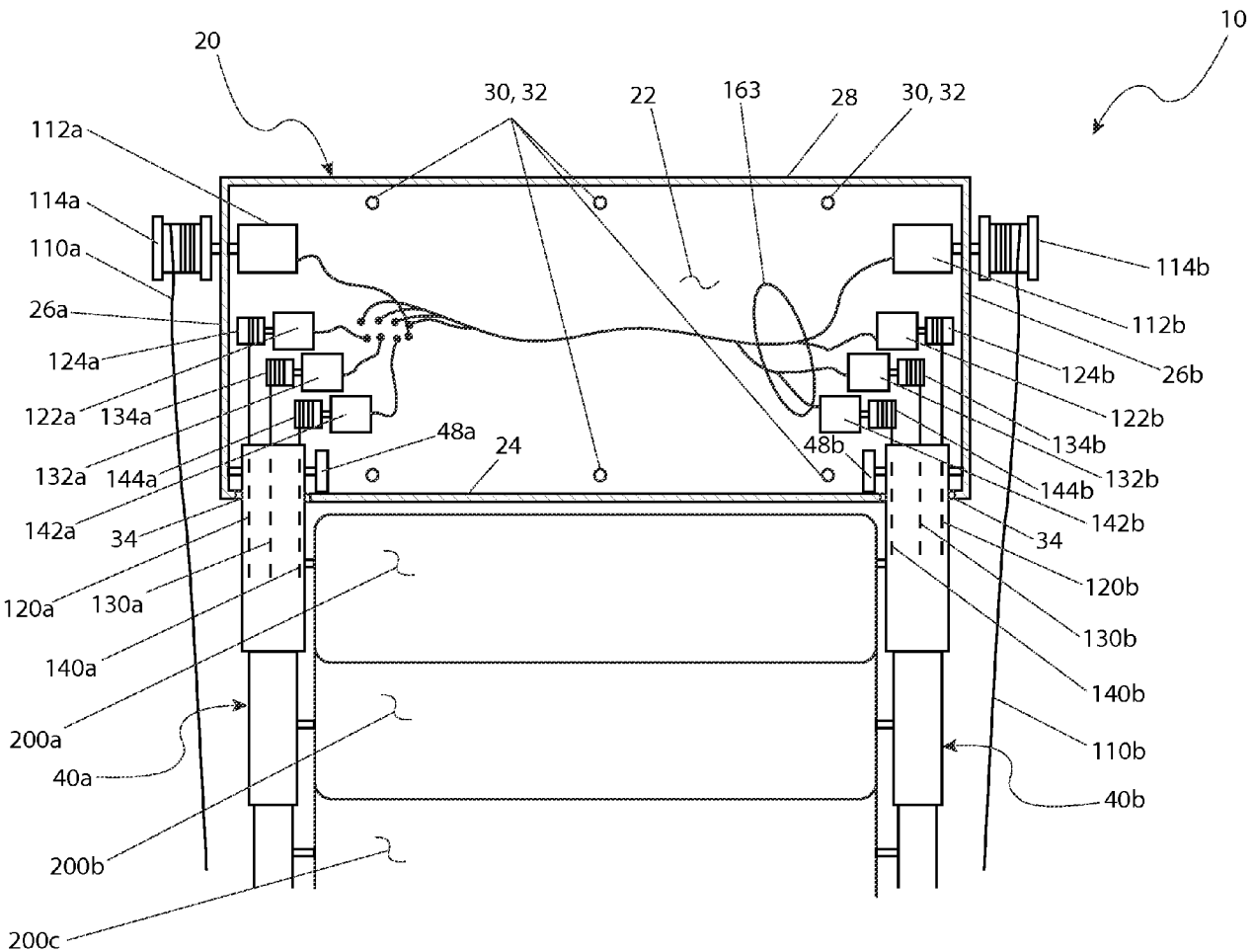
FIG. 3 is a sectional view of the retractable awning system 10 taken along section line A-A (see FIG. 1), according to a preferred embodiment of the present invention.
Figure 4:
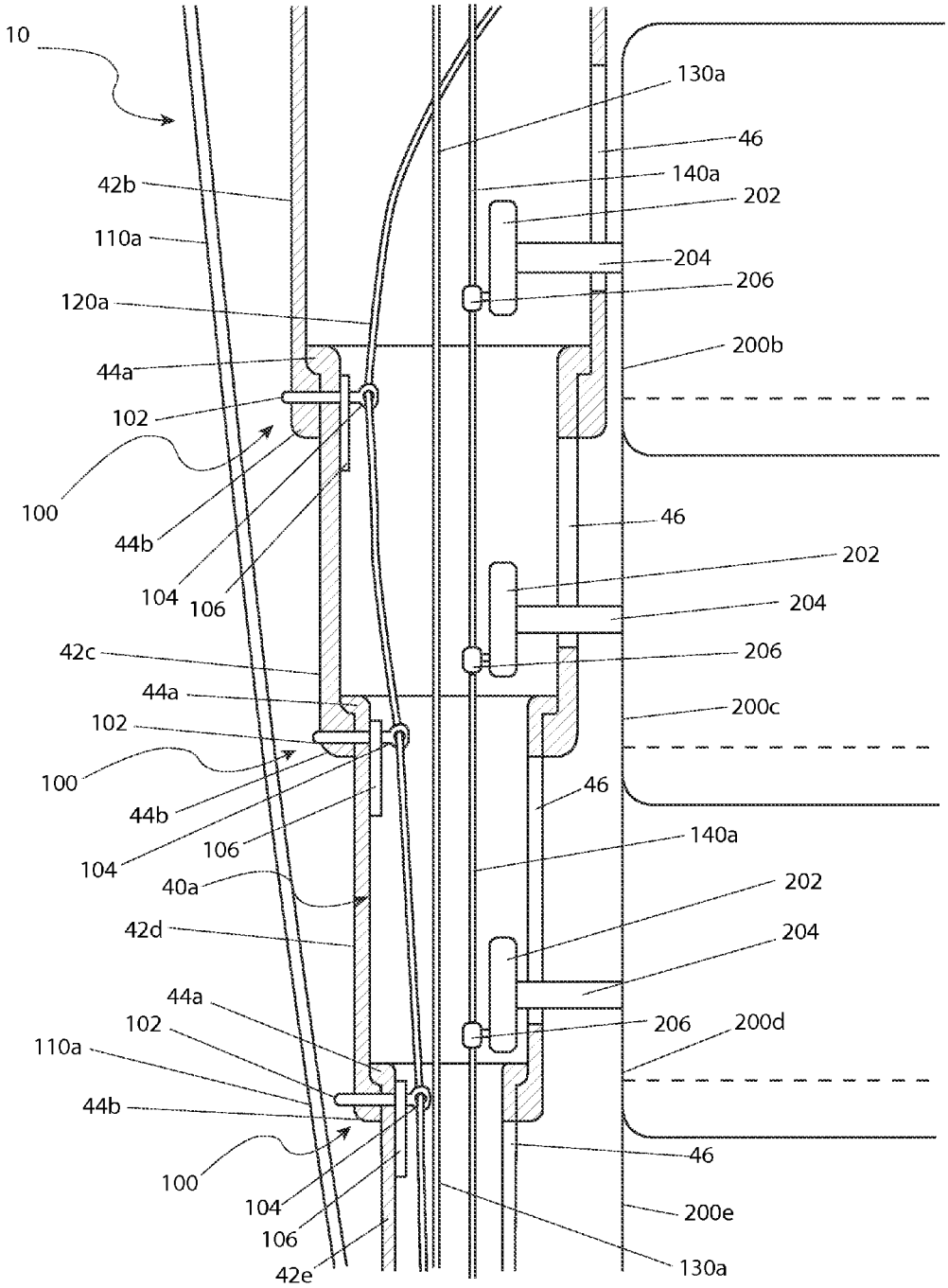
FIG. 4 is another sectional view of the retractable awning system 10 taken along section line B-B (see FIG. 1), according to a preferred embodiment of the present invention.
Figure 5:
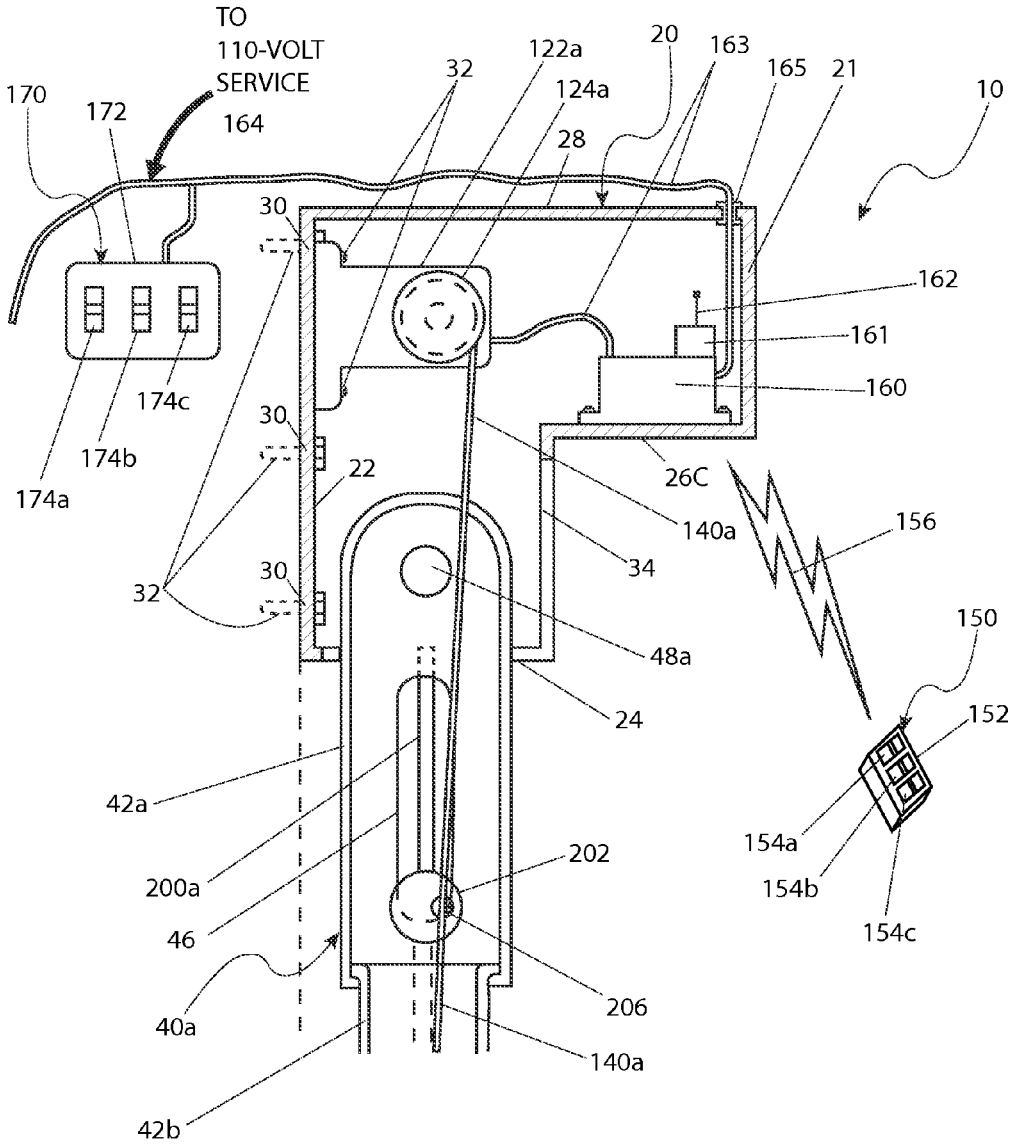
FIG. 5 is another sectional view of the retractable awning system 10 taken along section line C-C (see FIG. 1), according to a preferred embodiment of the present invention.

Referring now to FIGS. 3, 4, and 5, sectional views of the system 10, according to the preferred embodiment of the present invention, are disclosed. The housing assembly 20 provides a protective containment of a plurality of motors 112*a*, 112*b*, 122*a*, 122*b*, 132*a*, 132*b*, 142*a*, 142*b*, cable take-up pulleys 114*a*, 114*b*, 124*a*, 124*b*, 134*a*, 134*b*, 144*a*, 144*b*, and associated electrical and electronic motor control equipment, including a control module 160, necessary to manipulate an configure the louvered panel assembly 38 as well as the individual louvers 200*a*, 200*b*, 200*c*, 200*d*, 200*e*. Additionally, the system 10 provides hard-wired switching of this equipment via a switch panel assembly 170, as well as a means of wireless control via a hand-held remote controller 150.

The system 10 provides a means to tilt the louvered panel assembly 38 out away from the structure 220 via a first louvered panel lift cable 110*a* and a second louvered panel lift cable 110*b*. The lift cables 110*a*, 110*b* extend from respective first lift pulley 114*a* and second lift pulley 114*b* portions which protrude outwardly from respective first housing side panel 26*a* and second housing side panel 26*b* portions of the housing assembly 20. The lift pulleys 114*a*, 114*b* are positioned adjacent to the front housing panel 21, therefore being forwardly offset from the structure 220 and the louvered panel assembly 38, thereby allowing the louvered panel lift cables 110*a*, 110*b* to lift a bottom edge of the louvered panel assembly 38 out away from the structure 220 (see FIGS. 1 and 2). The first lift pulley 114*a* and second lift pulley 114*b* portions are in mechanical communication with respective first lift motor 112*a* and second lift motor 112*b* portions within the housing assembly 20. When activated, the lift motors 112*a*, 112*b* apply a torque to the respective pulleys 114*a*, 114*b*, thereby winding up the lift cables 110*a*, 110*b*, and lifting the post assemblies 40*a*, 40*b*, and louvered panel assembly 38 portions to a user-selected angle anywhere between a vertical and a horizontal orientation.

The support post assemblies 40*a*, 40*b* include telescoping and interlocking sections preferably having incrementally decreasing diameters, with the uppermost first post section 42*a* being the largest and having a diameter of approximately four inches (4 in.). Opposing pairs of post sections 42*a*, 42*b*, 42*c*, 42*d*, 42*e* support end portions of corresponding and respective louvers 200*a*, 200*b*, 200*c*, 200*d*, 200*e*. An embodiment of the support post assemblies 40*a*, 40*b* is shown here, wherein each has five (5) hollow tubular post sections 42*a*, 42*b*, 42*c*, 42*d*, 42*e*. Each post section 42*a*, 42*b*, 42*c*, 42*d*, 42*e* includes a means of mechanical attachment to an adjacent post section 42*a*, 42*b*, 42*c*, 42*d*, 42*e* via integral formed features including an outwardly protruding first lip feature 44*a* formed or machined all around a top edge, and an inwardly protruding second lip feature 44*b* formed or machined all around a bottom edge, to form an interlocking connection. The lip features 44*a*, 44*b* allow adjacent sections 42*a*, 42*b*, 42*c*, 42*d*, 42*e* to slide freely within each other while acting as a mechanical down-stop to retain an identical length of the support post assemblies 40*a*, 40*b*.

Extension and deployment of each support post assembly 40*a*, 40*b* takes place as the post sections 42*a*, 42*b*, 42*c*, 42*d*, 42*e* are allowed to descend vertically due to the effect of a gravitational force. When in a fully extended relationship, the adjacent post sections 42*a*, 42*b*, 42*c*, 42*d*, 42*e* are locked in relative position to each other by spring pins 102 which are incorporated within the previously described first 44*a* and second 44*b* lip features. The spring pins 102 are to be similar to devices commonly used to secure tent and awning poles together, utilizing an outwardly biasing leaf spring 106. Additionally, the spring pins 102 are synchronously retracted and released from their respective post sections 42*a*, 42*b*, 42*c*, 42*d*, 42*e* via respective integral pin eyelet portions 104 located upon an inner end portion thereof. The pin eyelets 104 within the first support post assembly 40*a* and second support post assembly 40*b* are tied, clipped, or otherwise affixed to respective first spring pin release cable 120*a* and second spring pin release cable 120*b* portions. The spring pin release cables 120*a*, 120*b* are routed upwardly within respective support post assemblies 40*a*, 40*b* and into the housing assembly 20 where the spring pin release cables 120*a*, 120*b* are wound around respective first release pulley 124*a* and second release pulley portions causing withdrawal of the spring pins 102 and release of the adjacent post sections 42*a*, 42*b*, 42*c*, 42*d*, 42*e* when the spring pin release cables 120*a*, 120*b* are wound up. The release pulleys 124*a*, 124*b* in turn are acted upon by respective first release motor 122*a* and second release motor 122*b* portions within the housing assembly 20.

Figure 6:
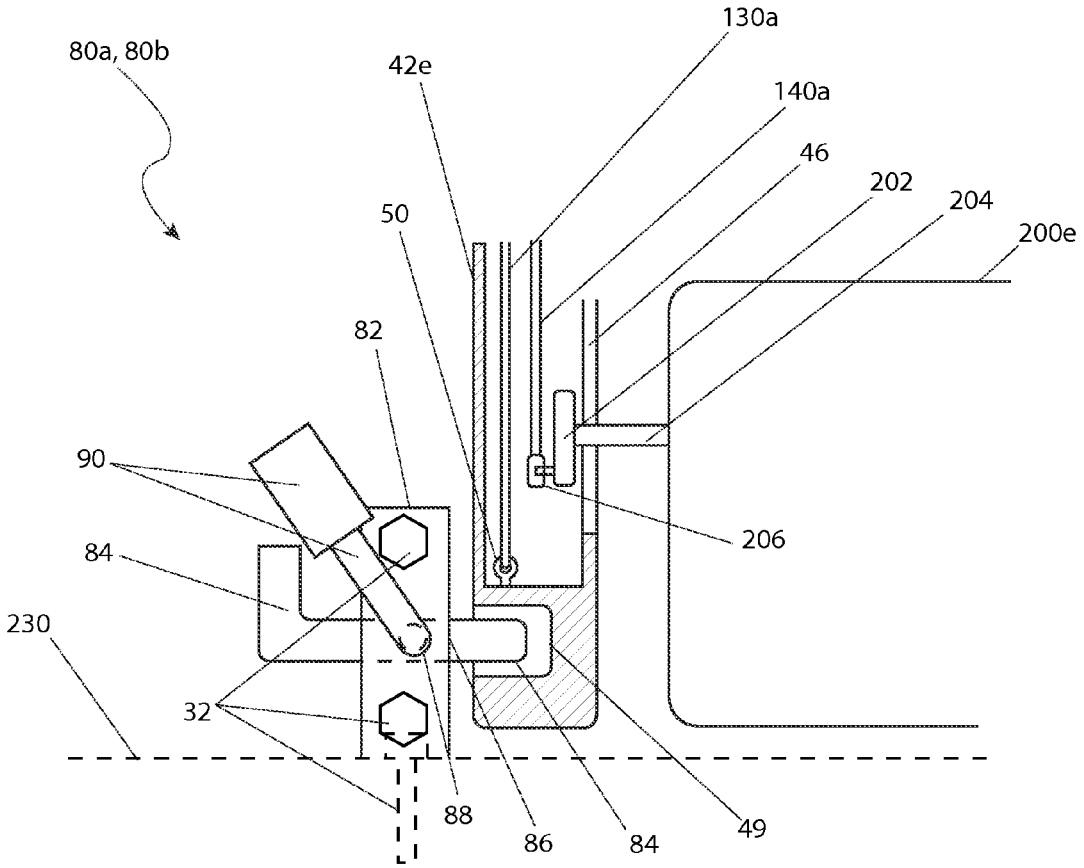
FIG. 6 is a sectional view of either locking assembly portion 80*a*, 80*b* of the retractable awning system 10 taken along section line D-D (see FIG. 1), according to a preferred embodiment of the present invention; and, FIG. 7 is an electrical block diagram of the retractable awning system 10, according to a preferred embodiment of the present invention.

Also routed within the hollow support post assemblies 40*a*, 40*b* are respective first post collapsing cable 130*a* and second post collapsing cable 130*b* portions being affixed at respective bottom end portions to eyelets 50 being threadingly or otherwise stationarily affixed to an inner bottom portion of each fifth post section 42*e* of the support post assemblies 40*a*, 40*b* (see FIG. 6). The upper end portions of each post collapsing cable 130*a*, 130*b* are in turn wound around respective first collapsing pulley 134*a* and second collapsing pulley 134*b* portions being acted upon by respective first collapsing motor 132*a* and second collapsing motor 132*b* portions mounted within the housing assembly 20. As the post collapsing cables 130*a*, 130*b* are wound around the collapsing pulleys 134*a*, 134*b* the fifth post sections 42*e* are lifted, consequently lifting the superjacent sections 42*a*, 42*b*, 42*c*, 42*d* into a collapsed and compact state.

The system 10 also includes a first louver rotate cable 140*a* and a second louver rotate cable 140*b* also routed within respective support post assemblies 40*a*, 40*b* which provide a means to tilt the louvers 200*a*, 200*b*, 200*c*, 200*d*, 200*e* in a synchronous manner with respect to the louvered panel assembly 38. Each louver 200*a*, 200*b*, 200*c*, 200*d*, 200*e* provides integral attaching portions located at each end including a louver pulley 202 and a connecting louver pulley shaft 204. The louver pulley 202 and shaft 204 portions protrude through a post slot portion 46 of each post section 42*a*, 42*b*, 42*c*, 42*d*, 42*e*, being located along an inward-facing surface. The post slot 46 provides an oval-shaped opening which provides vertical guidance and a bottom stopping means to the louver pulley 202 and shaft 204 portions. When the support post assemblies 40*a*, 40*b* are in an extended and locked state, the louver pulley shafts 204 of each louver 200*a*, 200*b*, 200*c*, 200*d*, 200*e* rest upon a bottom portion of the post slots 46 as seen in FIG. 5.

The louver rotate cables 140*a*, 140*b* are affixed to respective louver pulleys 202 at an offset location via pulley cable fasteners 206. In use, the louver rotate cables 140*a*, 140*b* are wound up by respective first rotate pulley 144*a* and second rotate pulley 144*b* portions, being acted upon by respective first rotate motor 142*a* and second rotate motor 142*b* portions, causing each louver pulley 102 and affixed louver 200*a*, 200*b*, 200*c*, 200*d*, 200*e* to rotate to a selectable angle of between zero and approximately ninety (0°-90°) degrees within the post slot 46.

Referring now to FIG. 5, another sectional view of the system 10 taken along section line C-C (see FIG. 1), according to a preferred embodiment of the present invention, is disclosed. The control module portion 160 of the system 10 provides activation and control of opposing pairs of motors 112*a*, 112*b*, 122*a*, 122*b*, 132*a*, 132*b*, 142*a*, 142*b* in a synchronized manner. The control module 160 is mounted within the housing assembly 20 on an interior surface of the third housing side panel 26*c* and is in electrical communication with each motor 112*a*, 112*b*, 122*a*, 122*b*, 132*a*, 132*b*, 142*a*, 142*b* via interconnecting wiring 163 (see FIG. 7). The switch panel assembly 170 is envisioned to provide push-button control of the previously described functions of the system 10 including the tilting of the louvered panel assembly 38, the collapsing of the post assemblies 40*a*, 40*b*, and the tilting of the louver portions 200*a*, 200*b*, 200*c*, 200*d*, 200*e*. An embodiment of the switch panel assembly 170 is illustrated here having a switch panel housing 172 capable of being mounted to a vertical support structure, a first switch panel switch 174*a*, a second switch panel switch 174*b*, and a third switch panel switch 174*c*. It is envisioned that power source wiring 164 from the existing electrical system within the structure 220 be utilized to provide electrical power to the control module 160, subsequently routing power to the previously described portions of the system 10 via additional wiring 163.

The control module 160 also works in conjunction with an RF receiver 161 also located within the housing assembly 20, and a hand-held remote controller 150. The remote controller 150 provides similar functionality as the previously described switch panel assembly 170, but in a wireless push-button manner. The receiver 161 is envisioned to include an integral antenna portion 162 and is capable of receiving and processing a plurality of RF signals 156 being transmitted from the remote controller 150. An embodiment of the remote controller 150 is illustrated here including a hand-held plastic remote controller housing 152, a first remote controller switch 154*a*, a second remote controller switch 154*b*, and a third remote controller switch 154*c*.

Referring now to FIG. 6, a sectional view of either locking assembly portion 80*a*, 80*b* of the system 10 taken along section line D-D (see FIG. 1), according to a preferred embodiment of the present invention, is disclosed. The system 10 includes a first lock assembly 80*a* and an opposing second lock assembly 80*b*, each being affixed to a bottom end portion of a respective support post assembly 40*a*, 40*b*. An embodiment of the lock assembly 80*a*, 80*b* is illustrated here wherein each lock assembly 80*a*, 80*b* includes an anchor bracket 82 which provides a means to secure the lock assembly 80*a*, 80*b* to a subjacent sill/floor surface 230 using at least one (1) fastener 32 such as a lag screw or masonry anchor.

Each lock assembly 80*a*, 80*b* also includes an "L"-shaped locking pin 84 which slides horizontally within a locking pin aperture 86 formed or machined through the anchor bracket 82. To secure the support post assemblies 40*a*, 40*b* in a fully deployed and vertical position, the locking pin 84 is motioned forwardly causing an end portion thereof to be inserted into a correspondingly positioned and shaped support post aperture portion 49 of each support post assembly 40*a*, 40*b*. Once inserted, a padlock 90 or similar securing device is inserted through a padlock aperture 88 being formed or machined through the anchor bracket 82 and locking pin 84 portions.

However, it is understood that various other securing methods and locking devices may be utilized as well without deviating from the teachings of the invention, and as such should not be interpreted as a limiting factor of the system 10.

Figure 7:
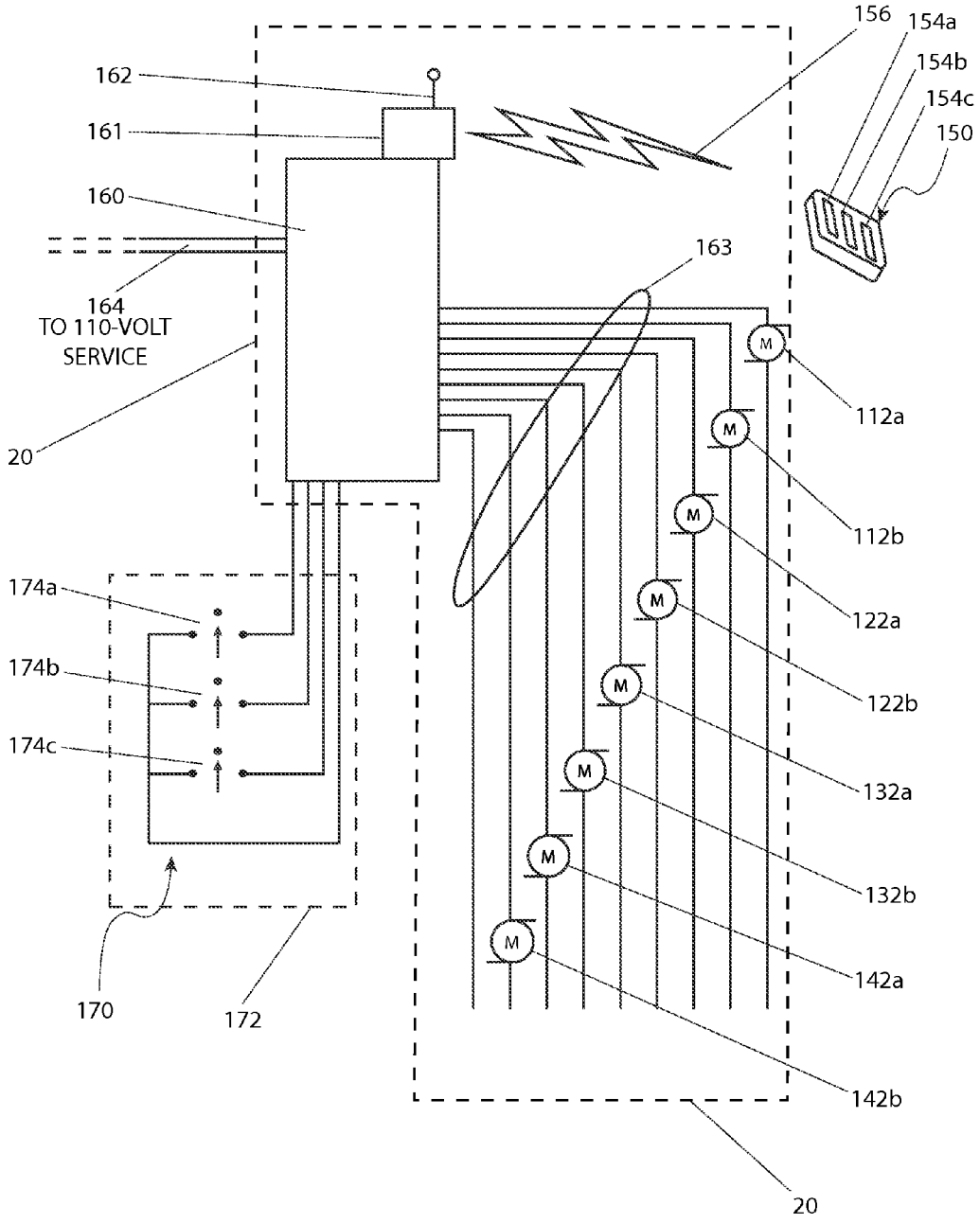

Referring now to FIG. 7, an electrical block diagram of the system 10, according to a preferred embodiment of the present invention, is disclosed. Electrical power to the system 10 is provided by power source wiring 164 from an existing 110-volt electrical system within the structure 220. The power source wiring 164 is routed and enters the housing assembly 20 using a sealing grommet 165, and is subsequently connected to the control module 160. The electrical power is subsequently routed from the control module 160 to the portions of the system 10 via additional wiring 163.

The control module 160 provides electrical and electronic motor control componentry necessary to manipulate and tilt the louvered panel assembly 38 and the individual louvers 200*a*, 200*b*, 200*c*, 200*d*, 200*e*. The system 10 provides hard-wired switching of motor portions 112*a*, 112*b*, 122*a*, 122*b*, 132*a*, 132*b*, 142*a*, 142*b* via a switch panel assembly 170, as well as wirelessly via a radio frequency (RF) signal 156 from a remote controller 150. The control module 160 provides current to the motors 112*a*, 112*b*, 122*a*, 122*b*, 132*a*, 132*b*, 142*a*, 142*b* in accordance with instructions contained within embedded software within the control module 160.

The control module 160 provides activation and control of opposing pairs of motors 112*a*, 112*b*, 122*a*, 122*b*, 132*a*, 132*b*, 142*a*, 142*b* in a synchronized manner. The control module 160 is envisioned to provide a microprocessor-based unit including electrical and electronic equipment such as, but not limited to: circuit boards, microprocessors, relays, embedded software, memory chips, and the like. The control module 160 also provides a wired interface 163 with the switch panel assembly 170 which is envisioned to be located and mounted conveniently within the structure 220.

The switch panel assembly 170 includes a plurality of switch panel switches 174*a*, 174*b*, 174*c* envisioned to be three-position rocker-type devices which provide a spring-return to center function. The control module 160 also works in conjunction with an RF receiver 161 envisioned to include an integral antenna portion 162 capable of receiving and processing a plurality of RF signals 156 transmitted from the hand-held remote controller 150. The RF signals 156 transmitted by the remote controller 150 are envisioned to be one-way signals 156 and do not provide for duplex communication or confirmation of a received RF signal 156. It is envisioned that the RF signals 156 would be a frequency modulated (FM) type on a frequency authorized for such use; however, other methods of modulation such as amplitude modulation, single side band, digital, continuous wave and the like would work equally well, and as such, should not be interpreted as a limiting factor of the present invention 10. The remote controller 150 includes three (3) remote controller switches 154*a*, 154*b*, 154*c* also envisioned to be three (3) position rocker-type devices which provide a spring-return to center function.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIG. 1.

The method of installing and utilizing the system 10 may be achieved by performing the following steps: acquiring a model of the system 10 having desired dimensions suitable for the spatial parameters and constraints of the window/door opening portion 210 of the structure 220 onto which the system 10 is to be installed; attaching the housing assembly portion 20 of the system 10 to a side surface of the structure 220 using the fastener apertures 30 of the rear housing panel 22 and corresponding fasteners 32 such as lag screws, wall anchors, or the like; connecting existing power source wiring 164 within the structure 220 to the control module 160; anchoring the lock assemblies 80*a*, 80*b* to a sill/ground surface 230 being positioned adjacent to the support post assembly portions 40*a*, 40*b* of the system 10 when in a fully extended state; mounting the switch panel assembly 170 at a convenient location within the structure 220; connecting wiring 163 between the control module 160 and the switch panel assembly 170; utilizing the toggle-switch portions 154*a*, 154*b*, 154*c* of the remote controller 150, or the switch panel switches 174*a*, 174*b*, 174*c* of the switch panel assembly 170 to manipulate the tilt of the louvered panel assembly 38 and the angle of the louver portions 200*a*, 200*b*, 200*c*, 200*d*, 200*e* to obtain a desired lighting effect; allowing the motors 112*a*, 112*b*, 122*a*, 122*b*, 132*a*, 132*b*, 142*a*, 142*b* and cable take-up pulleys 114*a*, 114*b*, 124*a*, 124*b*, 134*a*, 134*b*, 144*a*, 144*b* of the system 10 to extend and retract the support post assemblies 40*a*, 40*b*, to tilt the louvered panel assembly 38 to a desired angle from the structure 220, and to tilt the louvers 200*a*, 200*b*, 200*c*, 200*d*, 200*e* to create a desired lighting or shading effect; manipulating and reconfiguring the system 10 as weather and sunlight conditions change throughout the day; securing the system 10 in a closed and extended state when desired, or in an event of inclement weather conditions, by fully extending the support post assemblies 40*a*, 40*b* in a vertical downward direction; tilting the louvers 200*a*, 200*b*, 200*c*, 200*d*, 200*e* to a closed position against each other; inserting the locking pin portions 84 of the lock assemblies 80*a*, 80*b* into corresponding lock aperture portions 49 of the support post assemblies 40*a*, 40*b*; inserting and latching respective padlocks 90 through padlock aperture portions 88 of the lock assemblies 80*a*, 80*b*; and, benefiting from motorized control of exterior light entering a window/door opening 210 as well as providing added security to a structure 220, afforded a user of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A retractable awning comprising:

a housing assembly, adapted to be mounted to a structure above an opening thereof;

a first post assembly attached to and extending down from a first side of said housing assembly;

a second post assembly attached to and extending down from a second side of said housing assembly; and, a louvered panel assembly attached to and supported by said first post assembly and said second post assembly;

wherein said louvered panel assembly, said first post assembly, and said second post assembly are synchronously and selectively tilted between an upper position and a lower position relative to said housing assembly via a tilting adjustment means;

wherein said louvered panel assembly, said first post assembly, and said second post assembly are synchronously and selectively raised or lowered relative to said housing assembly by a vertical adjustment means;

wherein said louvered panel assembly is selectively opened or closed relative to said first and second post assemblies by an opening adjustment means;

wherein a control panel is located within said housing and in electrical communication between a controller and said tilting adjustment means, said vertical adjustment means, and said opening adjustment means; and, wherein said control panel independently operates said tilting adjustment means, said vertical adjustment means, and said opening adjustment means.

2. The retractable awning recited in claim 1, wherein said first and second post assemblies each further comprise a plurality of telescoping post elements.

3. The retractable awning recited in claim 2, wherein said louvered panel assembly comprises a plurality of louver panels each attached to and spanning a distance between an individual post element of each said first post assembly and said second post assembly.

4. The retractable awning recited in claim 3, further comprising:

a first plurality of spring pins, each affixing adjacent post elements of said first post assembly to each other;

a first release pulley housed within said housing;

a first release cable, attached between said first release pulley and attached to each of said first plurality of spring pins;

a first release motor in electrical communication with said control panel and operably motioning said first release pulley;

a second plurality of spring pins, each affixing adjacent post elements of said second post assembly to each other;

a second pulley housed within said housing;

a second release cable, attached between said second release pulley and attached to each of said second plurality of spring pins; and, a second release motor in electrical communication with said control panel and operably motioning said second release pulley;

wherein said control panel activates said first release motor to synchronously release each of said first plurality of spring pins to disengage adjacent post elements of said first post assembly from each other; and, wherein said control panel activates said second release motor to synchronously release each of said second plurality of spring pins to disengage adjacent post elements of said second post assembly from each other.

5. The retractable awning recited in claim 3, wherein said tilting adjustment means includes:

a first lift pulley extending outwardly from said housing first side;

a first lift cable routed around said first lift pulley and affixed to a lower end of said first post assembly;

a first lift motor in electrical communication with said control panel and operably motioning said first lift pulley;

a second lift pulley extending outwardly from said housing second side;

a second lift cable routed around said second lift pulley and affixed to a lower end of said second post assembly; and, a second lift motor in electrical communication with said control panel and operably motioning said second lift pulley;

wherein said control panel synchronously activates said first lift motor to operate said first lift pulley to gather said first lift cable and said second lift motor to operate said second lift pulley to gather said second lift cable in order to selectively tilt said first post assembly, said second post assembly, and said louvered panel assembly to a desired position.

6. The retractable awning recited in claim 5, wherein said first and second lift pulleys are located adjacent to a front panel of said housing, thereby offset from said first and second post assemblies and said louvered panel assembly.

7. The retractable awning recited in claim 3, wherein said vertical adjustment means includes:

a first collapsing pulley housed within said housing;

a first collapsing cable routed around said first collapsing pulley and affixed to a lower end of said first post assembly;

a first collapsing motor in electrical communication with said control panel and operably motioning said first collapsing pulley;

a second collapsing pulley housed within said housing;

a second collapsing cable routed around said second collapsing pulley and affixed to a lower end of said second post assembly; and, a second collapsing motor in electrical communication with said control panel and operably motioning said second collapsing pulley;

wherein said control panel synchronously activates said first collapsing motor to operate said first collapsing pulley to gather said first collapsing cable and said second collapsing motor to operate said second collapsing pulley to gather said second collapsing cable in order to selectively raise or lower said first post assembly, said second post assembly, and said louvered panel assembly to a desired position.

8. The retractable awning recited in claim 3, wherein said opening adjustment means includes:

a first rotating pulley housed within said housing;

a first rotating cable routed around said first rotating pulley and affixed to a first side of each of said plurality of louver panels;

a first rotating motor in electrical communication with said control panel and operably motioning said first rotating pulley;

a second rotating pulley housed within said housing;

a second rotating cable routed around said second rotating pulley and affixed to a second side of each of said plurality of louver panels; and, a second rotating motor in electrical communication with said control panel and operably motioning said second rotating pulley;

wherein said control panel synchronously activates said first rotating motor to operate said first rotating pulley to gather said first rotating cable and said second rotating motor to operate said second rotating pulley to gather said second rotating cable in order to selectively open or close said louvered panel assembly to a desired position between zero and approximately ninety degrees.

9. The retractable awning recited in claim 3, wherein said controller is a wall-mounted switch adapted to be in electrical communication with a power supply.

10. The retractable awning recited in claim 3, wherein said controller is a hand-held remote control device.

11. A retractable awning comprising:

a housing assembly, adapted to be mounted to a structure above an opening thereof;

a first post assembly attached to and extending down from a first side of said housing assembly;

a first locking assembly, comprising:

a first anchor bracket adapted to be affixed to a floor; and, a first locking pin horizontally engaging between a first locking pin aperture of said first anchor bracket and a first post aperture of a lower end of said first post assembly;

wherein a padlock is capable of securing aligned first lock apertures of said first anchor bracket and said first locking pin;

a second post assembly attached to and extending down from a second side of said housing assembly;

a second locking assembly, comprising:

a second anchor bracket adapted to be affixed to a floor; and, a second locking pin horizontally engaging between a second locking pin aperture of said second anchor bracket and a second post aperture of a lower end of said second post assembly;

wherein a padlock is capable of securing aligned second lock apertures of said second anchor bracket and said second locking pin; and, a louvered panel assembly attached to and supported by said first post assembly and said second post assembly;

wherein said louvered panel assembly, said first post assembly, and said second post assembly are synchronously and selectively tilted between an upper position and a lower position relative to said housing assembly via a tilting adjustment means;

wherein said louvered panel assembly, said first post assembly, and said second post assembly are synchronously and selectively raised or lowered relative to said housing assembly by a vertical adjustment means;

wherein said louvered panel assembly is selectively opened or closed relative to said first and second post assemblies by an opening adjustment means;

wherein a control panel is located within said housing and in electrical communication between a controller and said tilting adjustment means, said vertical adjustment means, and said opening adjustment means; and, wherein said control panel independently operates said tilting adjustment means, said vertical adjustment means, and said opening adjustment means.

12. The retractable awning recited in claim 11, wherein said first and second post assemblies each further comprise a plurality of telescoping post elements.

13. The retractable awning recited in claim 12, wherein said louvered panel assembly comprises a plurality of louver panels each attached to and spanning a distance between an individual post element of each said first post assembly and said second post assembly.

14. The retractable awning recited in claim 13, further comprising:

a first plurality of spring pins, each affixing adjacent post elements of said first post assembly to each other;

a first release pulley housed within said housing;

a first release cable, attached between said first release pulley and attached to each of said first plurality of spring pins;

a first release motor in electrical communication with said control panel and operably motioning said first release pulley;

a second plurality of spring pins, each affixing adjacent post elements of said second post assembly to each other;

a second pulley housed within said housing;

a second release cable, attached between said second release pulley and attached to each of said second plurality of spring pins; and, a second release motor in electrical communication with said control panel and operably motioning said second release pulley;

wherein said control panel activates said first release motor to synchronously release each of said first plurality of spring pins to disengage adjacent post elements of said first post assembly from each other; and, wherein said control panel activates said second release motor to synchronously release each of said second plurality of spring pins to disengage adjacent post elements of said second post assembly from each other.

15. The retractable awning recited in claim 13, wherein said tilting adjustment means includes:

a first lift pulley extending outwardly from said housing first side;

a first lift cable routed around said first lift pulley and affixed to said lower end of said first post assembly;

a first lift motor in electrical communication with said control panel and operably motioning said first lift pulley;

a second lift pulley extending outwardly from said housing second side;

a second lift cable routed around said second lift pulley and affixed to said lower end of said second post assembly; and, a second lift motor in electrical communication with said control panel and operably motioning said second lift pulley;

wherein said control panel synchronously activates said first lift motor to operate said first lift pulley to gather said first lift cable and said second lift motor to operate said second lift pulley to gather said second lift cable in order to selectively tilt said first post assembly, said second post assembly, and said louvered panel assembly to a desired position.

16. The retractable awning recited in claim 15, wherein said first and second lift pulleys are located adjacent to a front panel of said housing, thereby offset from said first and second post assemblies and said louvered panel assembly.

17. The retractable awning recited in claim 13, wherein said vertical adjustment means includes:

a first collapsing pulley housed within said housing;

a first collapsing cable routed around said first collapsing pulley and affixed to said lower end of said first post assembly;

a first collapsing motor in electrical communication with said control panel and operably motioning said first collapsing pulley;

a second collapsing pulley housed within said housing;

a second collapsing cable routed around said second collapsing pulley and affixed to said lower end of said second post assembly; and, a second collapsing motor in electrical communication with said control panel and operably motioning said second collapsing pulley;

wherein said control panel synchronously activates said first collapsing motor to operate said first collapsing pulley to gather said first collapsing cable and said second collapsing motor to operate said second collapsing pulley to gather said second collapsing cable in order to selectively raise or lower said first post assembly, said second post assembly, and said louvered panel assembly to a desired position.

18. The retractable awning recited in claim 13, wherein said opening adjustment means includes:

a first rotating pulley housed within said housing;

a first rotating cable routed around said first rotating pulley and affixed to a first side of each of said plurality of louver panels;

a first rotating motor in electrical communication with said control panel and operably motioning said first rotating pulley;

a second rotating pulley housed within said housing;

a second rotating cable routed around said second rotating pulley and affixed to a second side of each of said plurality of louver panels; and, a second rotating motor in electrical communication with said control panel and operably motioning said second rotating pulley;

wherein said control panel synchronously activates said first rotating motor to operate said first rotating pulley to gather said first rotating cable and said second rotating motor to operate said second rotating pulley to gather said second rotating cable in order to selectively open or close said louvered panel assembly to a desired position between zero and approximately ninety degrees.

19. The retractable awning recited in claim 13, wherein said controller is a wall-mounted switch adapted to be in electrical communication with a power supply.

20. The retractable awning recited in claim 13, wherein said controller is a hand-held remote control device.

* * * * *